United States Patent [19]

Johnson

[11] Patent Number: 4,795,038

[45] Date of Patent: Jan. 3, 1989

[54] BOTTLE RACK

[76] Inventor: W. Grady Johnson, 196 Wykoff Dr., Vacaville, Calif. 95688

[21] Appl. No.: 205,994

[22] Filed: Jun. 13, 1988

[51] Int. Cl.[4] ..... B01D 33/00

[52] U.S. Cl. ..... 211/74; 211/75; D6/467; D6/469; D7/71

[58] Field of Search ..... 211/74, 75, 72; D6/467, D6/469, 553; D7/71

[56] References Cited

U.S. PATENT DOCUMENTS

| | | | |
|---|---|---|---|
| D. 182,395 | 4/1958 | Ahlenius | D7/71 |
| D. 250,625 | 12/1978 | Leventhal | D6/188 |
| D. 252,065 | 12/1979 | Leventhal | D6/4 |
| D. 253,802 | 1/1980 | Loud et al. | D7/71 |
| 2,338,310 | 1/1944 | Barnes | 211/74 |
| 3,901,389 | 8/1975 | Belokin, Jr. | 211/74 |
| 4,482,065 | 11/1984 | Altemose | 211/74 |
| 4,496,124 | 1/1985 | Cole | 248/146 |

FOREIGN PATENT DOCUMENTS

| | | | |
|---|---|---|---|
| 66005 | 12/1982 | European Pat. Off. | 211/74 |
| 2543971 | 4/1977 | Fed. Rep. of Germany | 211/74 |
| 2123681 | 2/1984 | United Kingdom | 211/74 |

OTHER PUBLICATIONS

"Clearly Designed", Gifts and Decorative Accessories, Aug. 1972, p. 133.

House and Garden, Nov. 1971, 175, Universal Modular Corporation.

*Primary Examiner*—Ramon S. Britts
*Assistant Examiner*—David L. Talbott

[57] ABSTRACT

A rack which engages the necks of bottles through a plurality of spaced-apart, stalk mounted, bilaterally symmetrical, paired, tapered ring members and rigidly supports said bottles in a near horizontal position. Said ring members are arranged in front-rear pairs such that the neck of a bottle to be supported may be inserted therethrough and engage the tapered end of the front ring member along the lower portion of said neck and the tapered end of the rear ring member along the upper portion of said neck while said bottle is in the near horizontal position. Said supported bottle is held rigidly in place through the force of gravity acting on said bottle and against the four points of contact with said ring members. A plurality of stalk members connect and rigidly support said front ring members and said ring members respectively in columns or rows in the generally vertical plane. A plurality of spacing members rigidly connect the columns or rows of front ring members with the columns or rows of corresponding rear ring members and maintain the distance between the ring members of each ring member pair. A support structure provides means for rigidly supporting the rack on a surface or attachment to a wall, or the like.

10 Claims, 2 Drawing Sheets

FIG. 1
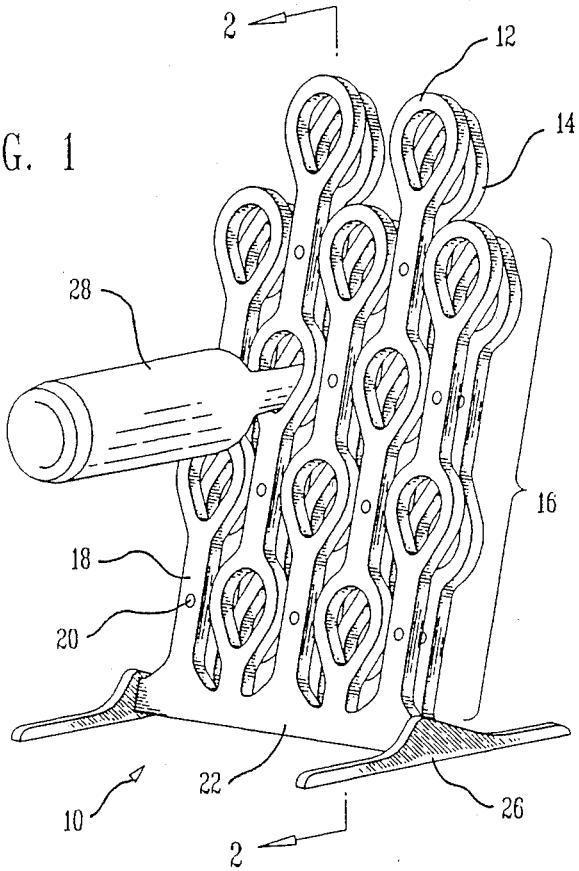
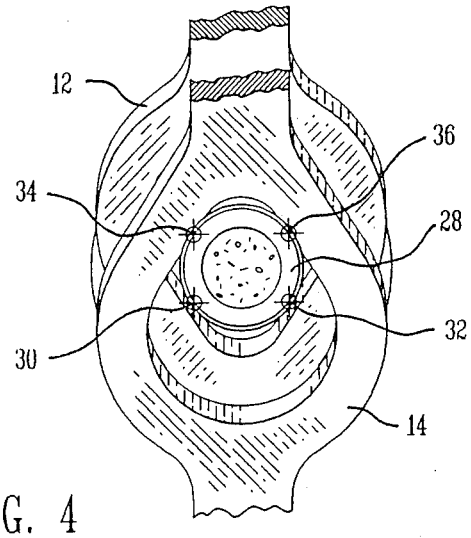
FIG. 4
FIG. 2
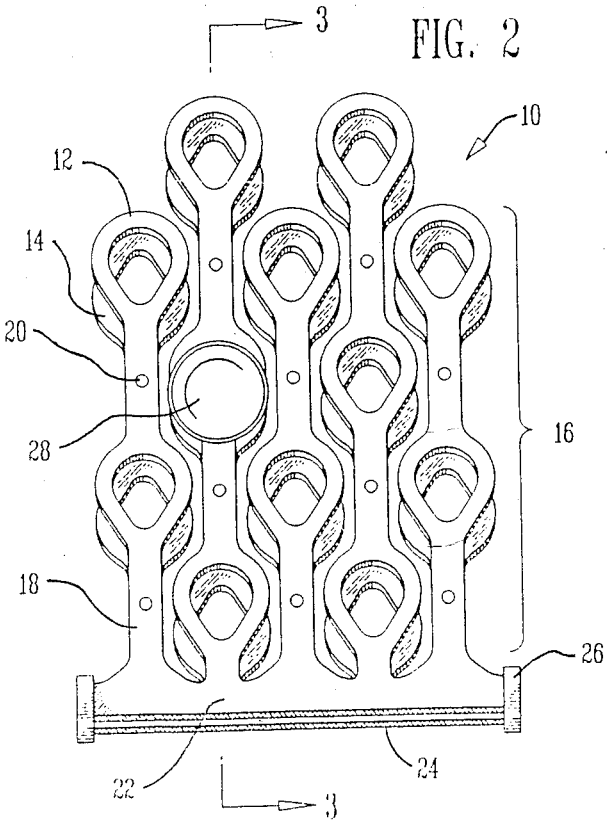
FIG. 3
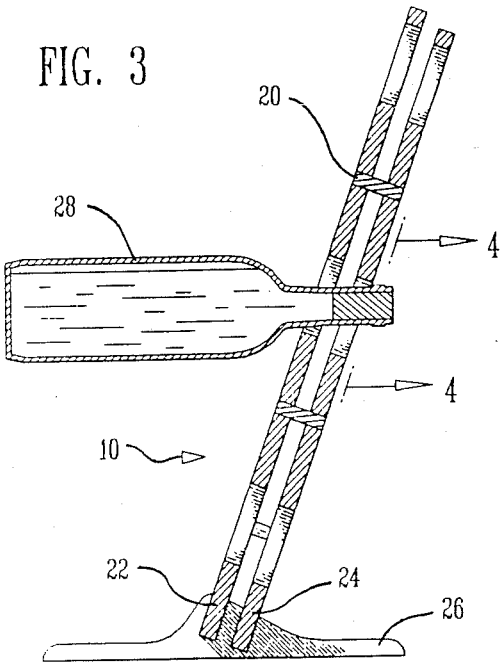

BOTTLE RACK

BACKGROUND ART

This invention relates to a bottle rack for the horizontal storage and display of long-necked bottles such as are commonly used in the storage and marketing of wine and champagne, in particular a rack which so supports such bottles solely by their necks.

Various bottle support devices are known in the prior art which utilize upright planar members with circular openings therein to engage the necks of bottles and support said bottles thereby. See, e.g., Leventhal U.S. Pat. No. Des. 250,625; Leventhal U.S. Pat. No. Des. 252,065; Loud et al. U.S. Pat. No. Des. 253,802; Barnes U.S. Pat. No. 2,338,310; and Cole U.S. Pat. No. 4,496,124.

These prior art bottle supports utilize circular apertures having a slightly larger diameter than the necks of the bottles to be supported thereby. In many of these bottle supports the neck of a bottle being supported contacts the support at one point along the lower front of the aperture and one point along the upper rear of the aperture. Only two points of contact are made between said bottle and the support structure, thereby allowing a considerable amount of undesirable lateral movement of said bottle. This lateral play causes the bottles in the rack to shake from side to side when the rack is disturbed and, in addition to giving the impression that the bottles are improperly secured, can stir up sediment in those bottles in which it occurs. This potential for undesirable lateral movement is accentuated when the circular openings must be enlarged to allow for the insertion of such large-capped or large-corked bottles as are used for champagne, and the like. In addition, the solid boards, walls, panels, or prisms required by these designs add considerably to the weight and apparent bulk of the rack structure.

Attempts at reducing lateral play through the addition of a third point of contact along the neck of the bottle, obtained through the use of steep aperture angles and/or planar member inclination angles, have been largely unsuccessful due to the fact that the third point is then positioned in the same vertical plane as the original two points with relation to the axis of the bottle. In addition, the steep angles required cause any sediment in the bottles to settle undesirably at the neck and create difficulty in reading the labels on the bottles.

Additional attempts at eliminating the potential for lateral movement have been made through the use of semi-resilient materials such as pressed paper or cardboard for the upright support members. While the edges of the supporting opening crush slightly under the load of the supported bottle such that the opening conforms to the shape of said bottle, it is seen that repeated insertion and removal of bottles causes a deterioration in the integrity of the structure. See Belokin, Jr. U.S. Pat. No. 3,901,389.

Where there have been attempts at eliminating the potential for lateral movement through the use of projecting support pegs, considerable bulk has been added to the structure. In addition, the structure itself has become conventional in that the rack supports the bottles in tiers rather than by the necks of said bottles. See Altemose U.S. Pat. No. 4,482,065.

Nowhere in the prior art is there seen an effective, durable, lightweight, and compact means of supporting bottles rigidly by their necks in a horizontal position while eliminating any lateral movement of said bottles so supported.

DISCLOSURE OF INVENTION

The present invention provides an improved bottle rack for the storage and display of long-necked bottles such as are used in the storage and marketing of wine and champagne. The rack includes a plurality of bilaterally symmetrical tapered ring members, each having internal cross sectional dimensions greater than the largest portion of the caps or corks of the bottles to be supported thereby and each with at least one tapered end which has an effective inner radius less than the radius of the narrowest portion of the necks of said bottles. The ring members are arranged in generally vertical pairs, with the corresponding members of each pair lying in parallel planes and having coplanar generally vertical axes. The spacing between said parallel planes is less than the length of the narrow portion of the necks of said bottles and said ring members are positioned with the front ring members having the tapered end downward and the rear ring members having the tapered end upward.

The neck of a bottle to be supported is inserted through a pair of ring members such that said neck engages the front ring member at two points of contact along the lower portion of said neck and said neck engages the rear ring member at two points of contact along the upper portion of said neck. The ring members of each pair are vertically offset from one another a distance whereby said neck engages said ring members while said bottle is in the near horizontal position. Said bottle, thusly supported, is held rigidly in position through the force of gravity acting on said bottle and against the four points of positive contact on opposite sides of said neck. Said bottle may be removed from the rack simply by lifting the exposed end of said bottle and withdrawing said neck from said paired ring members.

A plurality of stalk members connect said front ring members and said rear ring members respectively in columns or rows and support said ring members rigidly in the generally vertical plane. Said generally vertical plane may be inclined slightly rearward to facilitate reading of the labels of bottles supported by the rack. A plurality of spacing members rigidly connect the rows or columns of front ring members with the rows or columns of corresponding rear ring members and maintain the distance between the ring members of each ring member pair.

A suitable support structure provides means for rigidly supporting the stalk member - ring member assemblies in the desired position. Said support structure may include feet, legs, or any other base suitable for resting upon another surface, or may include brackets such as may be suitable for attachment to a wall, or the like. When the support structure includes means for resting upon another surface, said means will extend laterally from the lower portion of the rack a sufficient distance to prevent tipping of said rack regardless of whether said rack or the bottles therein are full, partially full, or empty.

The number of bottles which may be supported by the rack is determined by the number of paired ring members, which in turn is determined by the number and length of the stalk member pairs.

Among the objects of the present invention is the provision of a bottle rack which supports bottles horizontally by the necks of said bottles in a rigid fashion such that the potential for undesirable lateral movement is eliminated.

An additional object of the present invention is the provision of a very compact, durable, and lightweight bottle rack.

Another object of the present invention is the provision of a bottle rack which has an aesthetically pleasing, though unusual, appearance.

Yet another object of the present invention, in one embodiment thereof, is the provision of a bottle rack which allows the storage of a high density of bottles while maintaining ease of label readability and bottle access.

Still a further object of the present invention, in yet another embodiment thereof, is the provision of a bottle rack which may be mounted on a wall, or the like.

BRIEF DESCRIPTION OF DRAWINGS

The above and other objects of the invention will be more apparent through reference to the accompanying drawings wherein:

FIG. 1 is a perspective view of one form of a bottle rack built in accordance with the principles of the present invention and having a bottle supported thereby;

FIG. 2 is a front view taken along the lines 2—2 of FIG. 1;

FIG. 3 is a cross-sectional view taken along the lines 3—3 of FIG. 2 and through the supported bottle;

FIG. 4 is an enlarged fragmentary rear view taken along the lines 4—4 of FIG. 3 showing more specifically the method of engagement of the necks of the bottles by the rack;

DESCRIPTION OF THE PREFERRED EMBODIMENT

Figure 5:
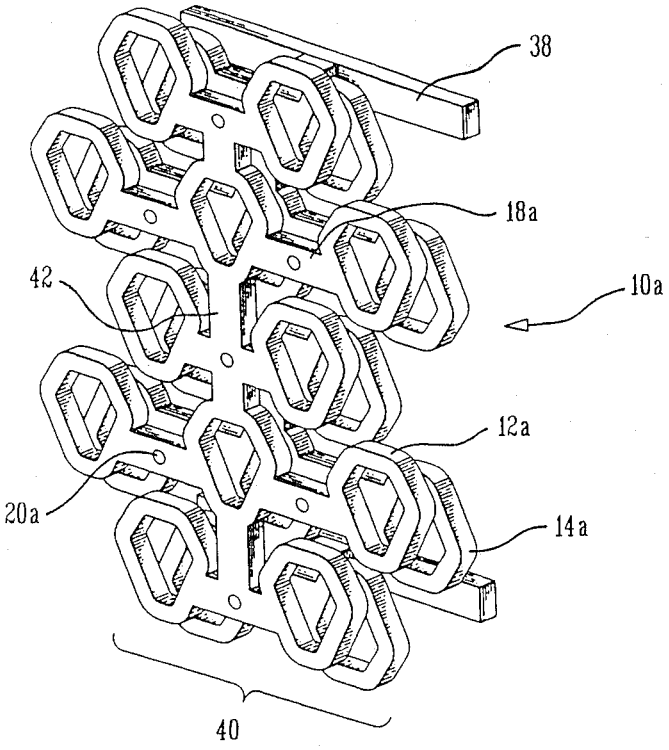
FIG. 5 is a perspective view of a modified bottle rack utilizing a different shape for the ring members, horizontal stalk members, and a wall-mounted support.

Referring to FIGS. 1-4, one form of bottle rack, suitable for twelve standard wine bottles, is shown to include a plurality of tapered oval ring members 12 and 14 arranged in generally vertical front-rear pairs and connected in columns 16 by stalk members 18 and spacing members 20, the columns being inclined slightly rearward from vertical. The lower stalk members of each column are connected at the lower end to support structures 22 and 24 which, in turn, are connected to and supported by base members 26. The rack 10 is shown having one bottle 28 inserted therein and supported thereby.

The ring members 12 and 14 are of the shape formed by tangentially connecting a large circle with a smaller circle lying partially outside the larger circle. Each has an internal radius at the larger end greater than the radius of the widest portion of the caps or corks of the bottles to be supported, and an internal radius at the tapered end less than the radius of the narrowest portion of the necks of the bottles to be supported. In one preferred embodiment, suitable for standard vine bottles, these distances are twenty-four millimeters and ten millimeters respectively. The ring members are positioned such that the front ring member 12 of each pair is located with the tapered end downward and the rear ring member 14 of each pair is located with the tapered end upward. As shown in FIG. 3, the ring members of each pair are spaced apart a distance whereby the horizontal distance from the front face of the front ring member to the rear face of the rear ring member is less than the length of the necks of the bottles to be supported. In one preferred embodiment, suitable for standard wine bottles, this horizontal distance is forty-one millimeters. This horizontal distance ensures that the area of support along the neck of the bottle 28 is sufficiently large to rigidly support the bottle while also ensuring that the bottle can be inserted far enough for positive engagement.

As shown in FIG. 4, the neck of a bottle 28 is inserted through a pair of ring members such that the neck engages the front ring member 12 at two points 30 and 32 along the lower portion of the neck and engages the rear ring member 14 at two points 34 and 36 along the upper portion of the neck. The rear ring member 14 of each pair of ring members is downwardly offset from the corresponding front ring member 12 a distance whereby the neck of the bottle 28 engages the ring members while the bottle is in the near horizontal position. The slight flange on the neck of the bottle assists in preventing the bottle from slipping out of the rack toward the front in the event said near horizontal position is actually sloped upward toward the neck of the bottle, as may be desired in a rack designed primarily for older wines which may contain a great deal of sediment. The bottle 28 is thusly supported in a cantilever arrangement and the four contact points 30, 32, 34, and 36 on opposite sides of the neck prevent any lateral movement. The bottle 28 is removed simply by lifting the exposed end, thereby releasing the neck from the ring members 12 and 14, and withdrawing the neck from the rack 10. This is quickly and easily accomplished without unnecessarily disturbing other bottles or stirring up any sediment in the bottle being removed.

The ring members 12 and 14 are held rigidly in place by stalk members 18 connecting front ring members 12 and rear ring members 14 respectively in columns 16. Each front column is connected to the corresponding rear column through a plurality of spacing members 20 which maintain the distance between the ring members 12 and 14 of each ring member pair. The spacing members 20 in the preferred embodiment comprise round dowels, although they may be rectangular or polygonal blocks or bars. The columns 16 are inclined slightly rearward which allows for the use of smaller base members 26 and provides for easier label reading. The base members 26 must extend far enough forward to prevent tipping when bottles are inserted into the lower ring member pairs and far enough rearward to prevent tipping when the rack is empty. In one preferred embodiment, suitable for twelve standard wine bottles, the columns 16 are inclined twenty degrees rearward from vertical, and the ring members 12 and 14 have a center to center spacing along each column of one hundred seventy-eight millimeters, and a center to center spacing between laterally adjacent columns of fifty-eight millimeters. The base members 26 extend forward from the bottom of the front support structure 22 a distance of one hundred twenty millimeters and rearward from the bottom of the rear support structure 24 a distance of one hundred twenty millimeters. In addition, the ring member pairs in adjacent columns are offset eighty-nine millimeters, as measured along each column, in order to facilitate optimal use of space. The column offsets and spacing between ring member pairs is largely a matter of personal taste, so long as the spacing is sufficient for the largest bottles which the rack may encounter. In this configuration, the rack 10 actually becomes more stable as more bottles 28 are inserted, due to the centering of the mass over the base. Bottles are easily inserted and removed, and the labels of all bottles in the rack are readable at all times.

In FIG. 5 there is shown a modified rack 10*a*, suitable for twelve standard wine bottles, and including hexagonal tapered ring members 12*a* and 14*a*, horizontal stalk members 18*a*, and wall-mounted support bracket 38.

As is the case with the ring member pairs of the rack shown in FIG. 1, the ring members of the modified rack 10*a* are arranged such that the front ring member 12*a* of each pair has the tapered end downward and the rear ring member 14*a* of each pair has the tapered end upward. In one preferred embodiment the hexagonal ring members have internal measurements of twenty-four millimeters along each of three adjacent sides, forty millimeters along each of two non-adjacent sides, and fourteen millimeters along the remaining side. The exact dimensions and number of sides are a matter of personal taste, so long as an opening through the ring member is provided which is large enough to accommodate the largest cap or cork to be encountered and two non-adjacent sides form a suitable cradle for the narrowest portion of the necks of the bottles to be supported.

The ring member pairs are located in the vertical plane, rather than being inclined rearward, and the horizontal spacing between the front face of the front ring member 12*a* and the rear face of the rear ring member 14*a* of each pair is modified to account for the lack of slope. In one preferred embodiment this distance is forty-five millimeters, but it may be any distance less than the actual length of the narrow portion of the necks of the bottles to be supported.

A bottle supported by the rack engages the two longest sides of the front ring member 12*a* along the lower portion of the neck of the bottle and the two longest sides of the rear ring member 14*a* along the upper portion of the neck of the bottle, much in the same way as the bottle 28 of FIG. 4 engages the oval ring members 12 and 14. The vertical offset between the front ring member 12*a* and the corresponding rear ring member 14*a* is, of course, modified so that engagement of the neck continues to occur while the bottle is in the near horizontal position.

The ring members 12*a* and 14*a* are held rigidly in place by stalk members 18*a* connecting front ring members 12*a* and rear ring members 14*a* respectively in horizontal rows 40. The front rows and rear rows are, in turn, connected respectively through centrally located vertical support structures 42. The front row-support assembly is connected to the rear row-support assembly through a plurality of spacing members 20*a* which maintain the distance between the ring members 12*a* and 14*a* of each ring member pair. Connected to the top and bottom of the rear row-support assembly are simple brackets 38 with which to attach the rack 10*a* to a wall, or the like. The brackets 38 extend rearward from the rack a sufficient distance whereby when the rack 10*a* is attached to a wall it is held parallel to, and a short distance from, the wall. The bracket 38 may be attached to the wall by any means including, but not limited to; bolts, dowels, screws, nails, or a sufficiently strong adhesive.

The horizontal and vertical spacing of the ring member pairs is, again, a matter of personal taste. In one preferred embodiment the spacing is similar to that used in the rack shown in FIG. 1, except that, because of the lack of rearward inclination, the vertical spacing is increased slightly to restore label visibility.

Figure 6:
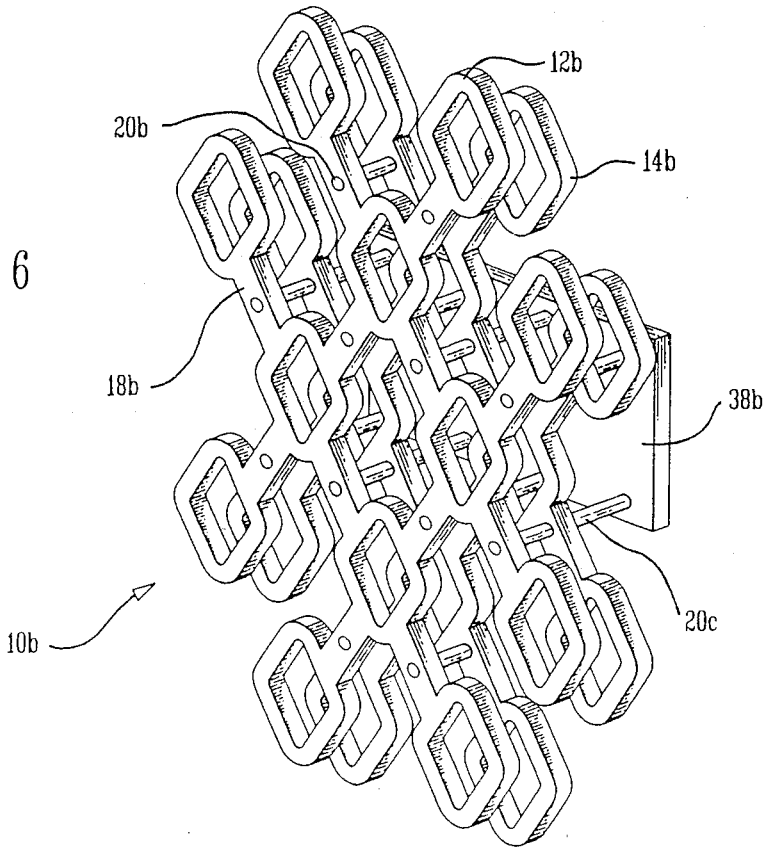
FIG. 6 is a perspective view of another modified bottle rack utilizing crossing diagonal stalk members and yet another shape for the ring members.

In FIG. 6 there is shown another modified rack 10*b*, suitable for twelve champagne bottles, and including rhombic ring members 12*b* and 14*b*, crisscrossing-crossing diagonal stalk members 18*b*, and a modified wall-mount bracket 38*b*.

Because the ring members are rhombic with one of the acute ends comprising the tapered end it is unnecessary to invert the rear ring member 14*b* in relation to the front ring member 12*b*. The rear ring members 14*b* are simply downwardly offset from the front ring members 12*b* a distance whereby the necks of the bottles to be supported engage the lower two sides of the front ring member 12*b* and the upper two sides of the rear ring member 14*b* while the bottles are in the near horizontal position. Again, the exact dimensions are not important so long as the opening in the ring member is large enough for the largest cap or cork which may be inserted therethrough. In one preferred embodiment, suitable for champagne bottles, the ring members have internal dimensions of fifty millimeters along each side with the tapered end comprised in one of two sixty degree angles.

The ring members 12*b* and 14*b* are held rigidly in the vertical plane by crisscrossing-crossing stalk members 18*b* connecting front ring members 12*b* and rear ring members 14*b* respectively in diagonal lattices. The front lattice is connected to the rear lattice through a plurality of spacing members 20*b* and 20*c* which maintain the distance between the ring members 12*b* and 14*b* of each ring member pair. The centrally located spacing members 20*c* extend through the rear lattice and serve as support structures connecting the rack 10*b* with the wall bracket 38*b*.

While champagne bottles can be stored in the racks depicted in FIGS. 1–5, their larger size interferes with label readability. Therefore, in the present embodiment, the horizontal and vertical spacings between ring member pairs are modified to allow for the larger champagne bottles. In one preferred embodiment the center to center vertical spacing is two hundred twenty-two millimeters and the horizontal center to center spacing is one hundred forty millimeters.

While the invention as illustrated in the accompanying drawings utilizes ring members and stalk members which have a generally rectangular cross section, the corners and edges may be rounded, or the ring members and stalk members may have a circular or elliptical cross section and may be of any width or thickness. In racks made of suitably strong material and having non-vertical stalk members, the ring members themselves may be so modified that they are open at the non-tapered end in order to further reduce the weight and/or simplify production.

Also, while the drawings depict a bottle support suitable for twelve bottles, it is obvious that by increasing the number of ring members and stalk members it is possible to design a rack in accordance with this invention which may hold any number of bottles. A suitable wall-mounted rack may cover an entire wall, for instance. Such a rack would take up considerably less space than a conventional rack that allowed the same degree of access to individual bottles.

While three specific embodiments are described herein, the individual components of each should be considered interchangeable. For example, a rack may have the tapered oval ring members shown in FIGS. 1–4, the horizontal stalk members shown in FIG. 5, and the wall-mount bracket shown in FIG. 6. The rack may be made of wood, plastic, steel, or any suitably rigid material and may be carved, machined, or cast.

There has been provided a compact, lightweight, aesthetically pleasing, and innovative bottle rack which may store a high density of bottles while maintaining ease of label readability. The rack allows for easy insertion and removal of bottles while eliminating the potential for undesirable lateral movement. It may be wall-mounted and because it has no moving parts and is constructed of rigid material it is quite durable.

It will be obvious to those skilled in the art that numerous variations could be made without departing from the spirit of the invention, and therefore the invention is not limited to that illustrated in the drawings and described in the specification, but only as indicated in the appended claims.

What is claimed is:

1. A bottle rack for the storage and display of long-necked bottles comprising:

a plurality of bilaterally symmetrical tapered ring members, each having a tapered end and having internal cross sectional dimensions greater than the largest portion of the cap or cork of said bottles and having, at the tapered end, an effective inner radius less than the radius of the narrowest portion of the necks of said bottles;

said ring members being arranged in generally vertical pairs, each pair consisting of one front ring member and one rear ring member lying in spaced apart parallel planes and having coplanar axes of symmetry, the tapered end of said front ring member being downward and the tapered end of said rear ring member being upward;

said spaced apart parallel planes having a distance between them such that the horizontal distance between the front face of a given front ring member and the rear face of the corresponding rear ring member is less than the length of the narrow portion of the necks of said bottles;

said rear ring members being vertically offset from said front ring members a distance whereby the neck of a bottle, when inserted therethrough, engages the tapered end of the front ring member at two points and the tapered end of the rear ring member at two additional points while in the near horizontal position and is supported thereby;

a plurality of stalk members connecting said front ring members and said rear ring members respectively in columns or rows and holding said ring members rigidly in the generally vertical plane;

a plurality of spacing members rigidly connecting the columns or rows of front ring members with the columns or rows of corresponding rear ring members; and support structure providing means for rigidly supporting the stalk members and thereby the ring members from a surface, regardless of whether the rack or bottles therein are full, partially full, or empty.

2. A rack as defined in claim 1, said ring members being symmetrical polygons having said tapered ends consisting of two sides forming an acute angle.

3. A rack as defined in claim 1, said ring members being broadly elliptical and having at least one tapered end.

4. A rack as defined in claim 1, said ring members being bilaterally symmetrical polygons, said tapered ends consisting of two non-adjacent sides forming an acute angle.

5. A rack as defined in claim 2, said stalk members being inclined up to thirty degrees rearward.

6. A rack as defined in claim 2, said support structure including a means for attachment to a wall, or the like.

7. A rack as defined in claim 3, said stalk members being inclined up to thirty degrees rearward.

8. A rack as defined in claim 3, said support structure including a means for attachment to a wall, or the like.

9. A rack as defined in claim 4, said stalk members being inclined up to thirty degrees rearward.

10. A rack as defined in claim 4, said support structure including a means for attachment to a wall, or the like.

* * * * *